US006068537A

United States Patent [19]

Lupton

[11] Patent Number: 6,068,537

[45] Date of Patent: May 30, 2000

[54] GAME APPARATUS AND METHOD

[75] Inventor: William George Lupton, North Yorkshire, United Kingdom

[73] Assignee: Go Sport Ltd, Ripon, United Kingdom

[21] Appl. No.: 09/068,276

[22] PCT Filed: Oct. 30, 1996

[86] PCT No.: PCT/GB96/02634

§ 371 Date: May 6, 1998

§ 102(e) Date: May 6, 1998

[87] PCT Pub. No.: WO97/17110

PCT Pub. Date: May 15, 1997

[30] Foreign Application Priority Data

Nov. 6, 1995 [GB] United Kingdom ..... 9522690
May 11, 1996 [GB] United Kingdom ..... 9609867

[51] Int. Cl.[7] ..... A63H 17/00; A63H 33/30; B62D 61/06; B60P 9/00

[52] U.S. Cl. ..... 446/435; 446/424; 446/456; 414/462; 180/215

[58] Field of Search ..... 446/435, 431, 446/424, 427, 437, 441, 442, 454, 456, 460; 180/210, 215, 216; 414/462

[56] References Cited

U.S. PATENT DOCUMENTS

| | | | |
|---|---|---|---|
| 3,201,898 | 8/1965 | Lahr et al. | 446/435 X |
| 3,240,201 | 3/1966 | Shelton | 446/435 X |
| 3,303,821 | 2/1967 | Harris | 446/456 X |
| 3,324,964 | 6/1967 | Davis | 180/215 X |
| 3,348,713 | 10/1967 | Will | 414/462 |
| 4,031,659 | 6/1977 | Keller et al. | 446/427 |
| 4,213,269 | 7/1980 | Grogg, Sr. | 446/435 X |
| 4,274,505 | 6/1981 | Maust | 180/215 |
| 4,516,648 | 5/1985 | Berger et al. | 180/210 X |
| 4,938,483 | 7/1990 | Yavetz | 446/456 X |
| 5,378,191 | 1/1995 | Ryaa | 446/424 |

*Primary Examiner*—D. Neal Muir
*Attorney, Agent, or Firm*—Klauber & Jackson

[57] ABSTRACT

The present invention is a vehicle, preferably a powered vehicle, which is adapted to play a game in which a ball (20), rolling free on a play surface (16), can be caught by the vehicle, held by the vehicle whilst it moves over the surface (16), and under the control of the driver, propelled to either side of the vehicle, to for example, shoot at a goal, or to pass to another player in a team, or to aim at an impact sensitive pad on the vehicle of an opposing team. The invention also related to a new method of steering vehicles.

20 Claims, 13 Drawing Sheets

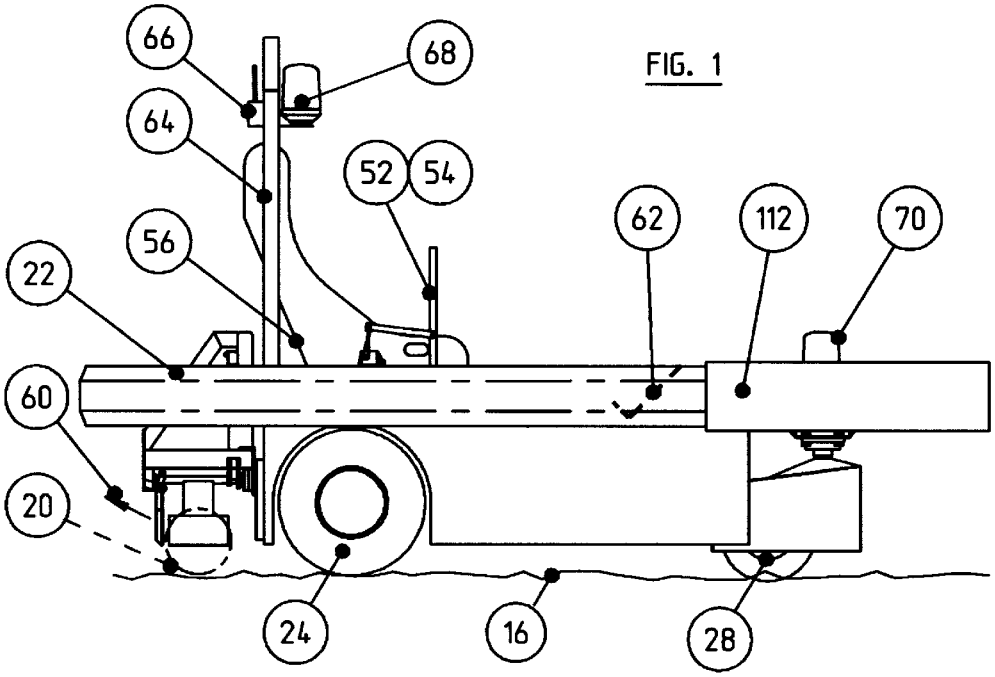
FIG. 1
FIG. 2
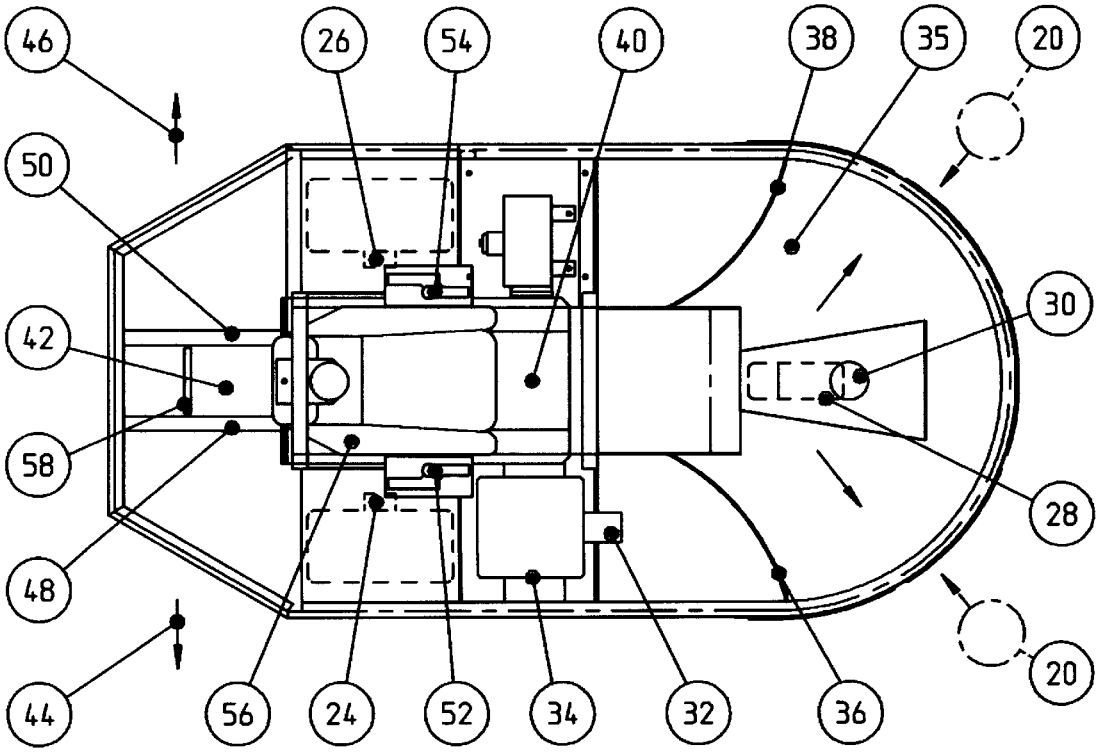

FIG. 3
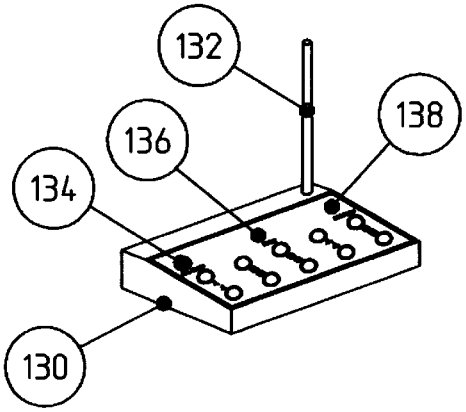
FIG. 5
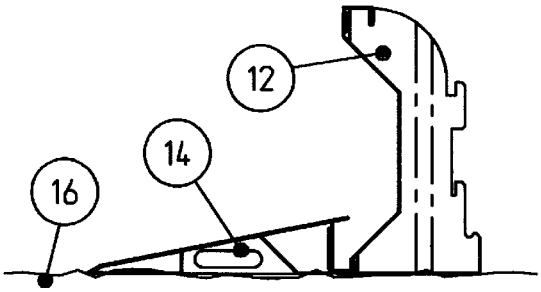
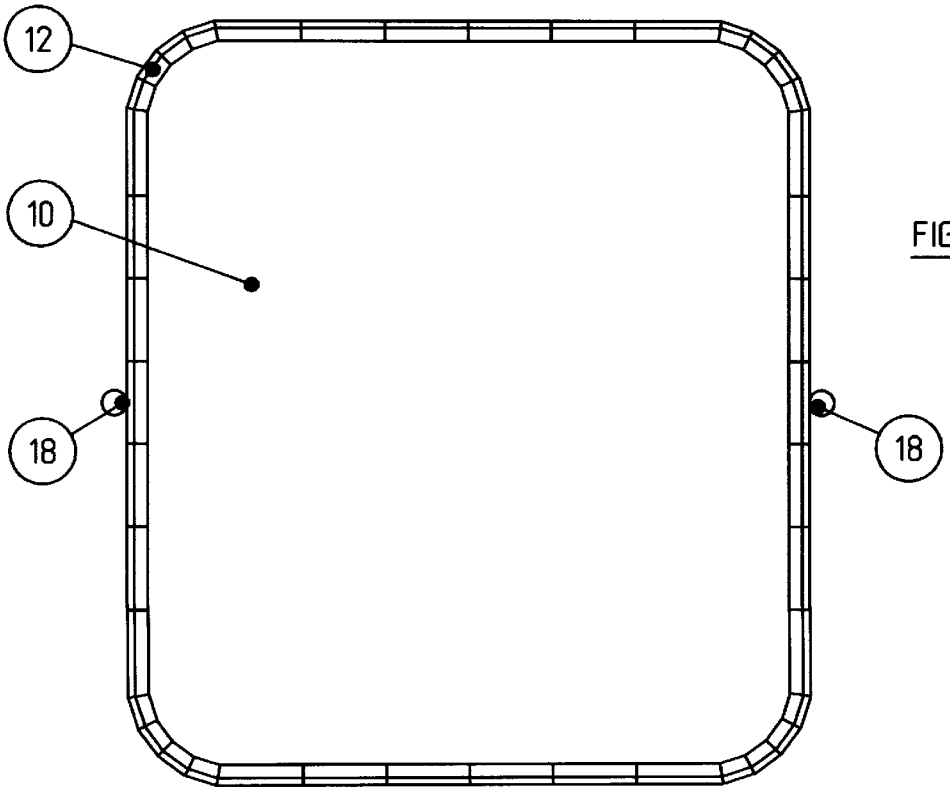
FIG. 4

GAME APPARATUS AND METHOD

This invention relates to a game apparatus and method, and provides a particularly novel form of game not heretofore conceived.

BACKGROUND OF THE INVENTION

The basis of the apparatus of the present invention is to provide a new vehicle or an attachment for a vehicle to convert it to a new vehicle, typically for occupation by a single occupant or player, although there may be two or more players in modified forms of the vehicle, and the vehicle is equipped in order to receive a playing ball or equivalent member such as a puck, to hold the ball, and to propel it from the vehicle. In some respects therefore the game can be compared to a game such as football or hockey except that the player's skills are transferred through a vehicle which in turn is equipped for receipt and propelling of the ball. The vehicle preferably is motorised, but it may be manually driven.

It is already known from U.S. Pat. No. 3,820,790 and German Patent Document DE-A-1578628 to provide a vehicle for the playing of a soccer like game, wherein the vehicle has a carrier member by which the ball is held and by which the ball can be propelled by reciprocation of the carrier member. Such a vehicle is however limited in that it requires the ball to be propelled from the carrier in the same direction in which it is received in the carrier, which limits its utility.

The U.S. Pat. No. 3,264,782 describes on the other hand a toy steam train into the tender of which balls are loaded, and from the funnel of which the balls can be propelled upwards, like puffs of steam, and a child playing with the toy can try to catch the balls. The device of U.S. Pat. No. 5,335,917 is somewhat similar in that a motorised bucket has an opening in its wall and balls are loaded into the top of the bucket, and are propelled out of the opening.

As in some of the prior arrangements indicated above, it is envisaged in the present invention that in one form of play of the game, there will be several motorised vehicles of the type to which the invention relates, controllable by respective players, and the vehicles will be arranged in teams, the respective teams playing on the playing field or pitch, provided with goals or goal areas or point scoring systems so that the objective of the game is to propel the ball into the goal or goal area, so that teams can score goals during periods of play, and, similar to soccer and hockey, and the winning team is the team which scores the more goals. Players will be required to exercise considerable skill in using the vehicles.

It is envisaged that in any one team there may be two types of vehicle, one for use by a player who will be designated to operate similar to a goal keeper, and a second type of which there may be several for use by the respective outfield players.

SUMMARY OF THE INVENTION

According to the invention there is provided a vehicle or an attachment for a vehicle for playing a game on a surface over which the vehicle or vehicle and attachment moves or move, comprising an inlet at the front of the vehicle or attachment for collecting a ball which rolls on the surface, a holding zone for holding the ball, and a propulsion means for propelling the ball from the side of the vehicle or attachment across the surface in a different direction from that in which it was received in the inlet.

Preferably, the vehicle is motorised, and the holding zone is preferably at the centre or the rear of the vehicle, and the ball is adapted to be propelled from the vehicle to either side of the vehicle at the option of the driver.

The propulsions means may comprise striking arms means whereby the ball can be propelled sideways from either side of the vehicle.

Preferably, the striking arm means comprises right and left arms, arranged so that when one arm strikes the ball the other is raised clear of the holding zone, and there may be resilient holding means for resiliently holding the ball in the holding zone, which resilient holding is overcome when the ball is propelled by the arms from the holding zone. In another preferred feature, the resilient holding means comprises flexible polypropylene bristles.

It is envisaged that in another preferred feature, the ball can be released from the holding zone, in addition to being propelled therefrom by forward propulsion of the vehicle, and to this end, there may be a closure plate defining the rear of the holding zone and means for raising the closure plate to release the ball when the vehicle moves forward.

The vehicle may be a three wheeled vehicle with a single front wheel and two rear wheels and the inlet extends from each side of the front wheel to the holding zone, and the vehicle prime mover is preferably drivingly connected to the respective rear wheels enabling them to be driven differentially. In this case, the front wheel suitably is a caster wheel.

A sensor means may be provided on the vehicle, so that, if the vehicle is impacted during use, such impact will be detected, and the sensor means may suitably be four sensors at the respective corners of the vehicle. Impacting may stop the vehicle automatically.

The vehicle may be adapted to be controlled by a transmitter and an indicator, in the form of a lamp, to indicate when the vehicle has been controlled (stopped) by the transmitter. The ball suitably is a ball.

To enable the game in a preferred embodiment to be played in an effective and enjoyable manner, there may be a goal for each side and one or more outfield vehicles, and each of the vehicles is as indicated generally above controllable by a person, or "referee" by means of a remote control device and therefore the referee may be remote from the playing pitch. In this connection the referee may be provided with a signaller which can transmit signals through space to the individual or all vehicles in order to immobilise same, for example to bring the game to a stop. Additionally or alternatively, the referee may be able to control individual vehicles to stop same, in the event for example of a player committing a breach of the rules. In this connection, each vehicle may be provided with a warning light which may be red and flashing in nature to indicate when the vehicle is immobilised by the referee, especially when the player thereof commits a breach of the rules, or simply when the vehicle is in play but is stopped. The referee controller may have an overall on/off switch so that when all vehicles are stopped at the end of a period of the game or at the end of the game all vehicles are immobilised and in such case the read warning lights may also be extinguished.

The referee's controller may be adapted to send unique control signals by transmission through the atmosphere. Such signals may be ultrasonic, infrared, radio waves or the like and both the referee controller and the vehicles may have transmission and reception aerials for this purpose.

The vehicle is especially adapted for the play of the game, and each has a number of novel and inventive features some of which are indicated above and which are discussed below.

Firstly, the vehicle is for receiving a single player and has a front end, a rear end, and sides defined by a framework which serves to protect the vehicle operational components and the vehicle wheels. To the underside of the frame at the front end, the vehicle is open in order to receive or catch the ball, which will normally be approximately the size of a regular soccer ball. A sub-chassis at a height of approximately the size of a regular soccer ball allows the ball to funnel towards the centre of the vehicle and then along a passage to the centre or rear of same for the collecting and holding of the ball.

Preferably, to the centre or rear of the vehicle is the holding and propelling device which serves to hold the ball in such a manner, whilst the ball still rests on the playing surface, that it can be transported by the vehicle over the playing surface, and upon operation of controls of the vehicle, can be propelled to the right or left of the vehicle by a propelling mechanism. In a modified arrangement, the device can be adapted to grip or hold the ball clear of the playing surface. The propelling mechanism preferably works in that the ball can be propelled at either of two or more rates i.e. with large force or with small force, under the control of the player. Additionally, a holding mechanism can be operated to release the ball rearwardly of the vehicle by allowing it to pass from the vehicle whilst the vehicle drives forward.

The control mechanism may comprise a pair of manually operated levers and buttons to the right and left of the position in which the player sits, and the vehicle may be provided with a warning light which may be green and preferably flashing, when the vehicle holds the ball so that spectators will be able to see which vehicle is in possession of the ball at any time during the game.

The machine may be provided with means to ensure that the player does not hold the ball excessively, so that the player will be prevented from keeping the ball in his possession for too long, which could stall play or make play too slow. Any suitable control means may be adopted for this purpose, but we prefer to adopt two methods, one of which is based upon distance of travel of the machine, and the other of which is based upon the time the ball is held by the machine. Either may have priority, and in the case of distance of travel, the control arrangement receives signals from the rotation of the vehicle wheels, and when a certain distance of travel has been detected, the ball is propelled automatically from the machine, in as random a manner as possible. Equally, if the player vehicle is stopped, or moving only slowly, the ball will be propelled automatically from it, after it has been held for a predetermined time.

The propelling means may comprise a pair of propulsion levers which are pivotally mounted to swing against the ball, and which are selectively controllable by means of a fluid pressure operated ram, or may be powered by electric magnets, or by a recoiled spring charged with energy.

The rear wheels are drive wheels and are preferably hydraulically driven and can be driven in the same or opposite directions for the driving of the vehicle forward, for the steering of same and for spinning of the vehicle approximately about its own centre.

A particularly unique hydraulic drive system has been developed for the vehicle and constitutes in itself an independent aspect of the present invention. The hydraulic system provides that for the steering of the vehicle, the flow of hydraulic fluid from the main pump to one of the drive motors is terminated, whilst full flow to the other is maintained, and the power supplied to the driven motor will cause the isolated drive motor to act as a pump, and suitable valve and dumping means are provided so that the motor driven as a pump will draw fluid from a sump and pump it back to the sump so that the not driven motor can continue rotating but at a lesser speed than the driven motor. This inventive aspect can be applied to any hydraulic drive system embodying two drive motors.

In another aspect of the invention, as indicated, the outfield vehicle is provided with a sensing means on the frame so that if the sensing means contacts another vehicle, the vehicle will automatically be immobilised, preferably for a pre-set period of time say one minute or two minutes so that that vehicle will be out of the game as it is considered that there should be no contact between vehicles during the play of the game. The immobilising means may comprise a pad or a series of pads attached to the front end of the frame of the vehicle and arranged so that if the front end of the vehicle contacts another vehicle., the pad will be actuated. When a vehicle is so immobilised its red flashing warning light may be operated during the time it is immobilised so that this will be observable by spectators.

Each vehicle will preferably be provided with all of the aspects of the invention, but is may be provided with only one or more as required.

BRIEF DESCRIPTION OF THE DRAWINGS

Embodiments of the invention will now be described, by way of example, with reference to the accompanying diagrammatic drawings, wherein:

FIGS. 1 and 2 respectively are a diagrammatic side elevation and plan of an outfield player vehicle;

FIG. 3 is a perspective view showing a referee controller device;

FIG. 4 is a plan view showing a playing field or area on which the game is played;

FIG. 5 is a sectional view showing the field periphery fence arrangement;

DETAILED DESCRIPTION OF THE INVENTION

Figure 2A:
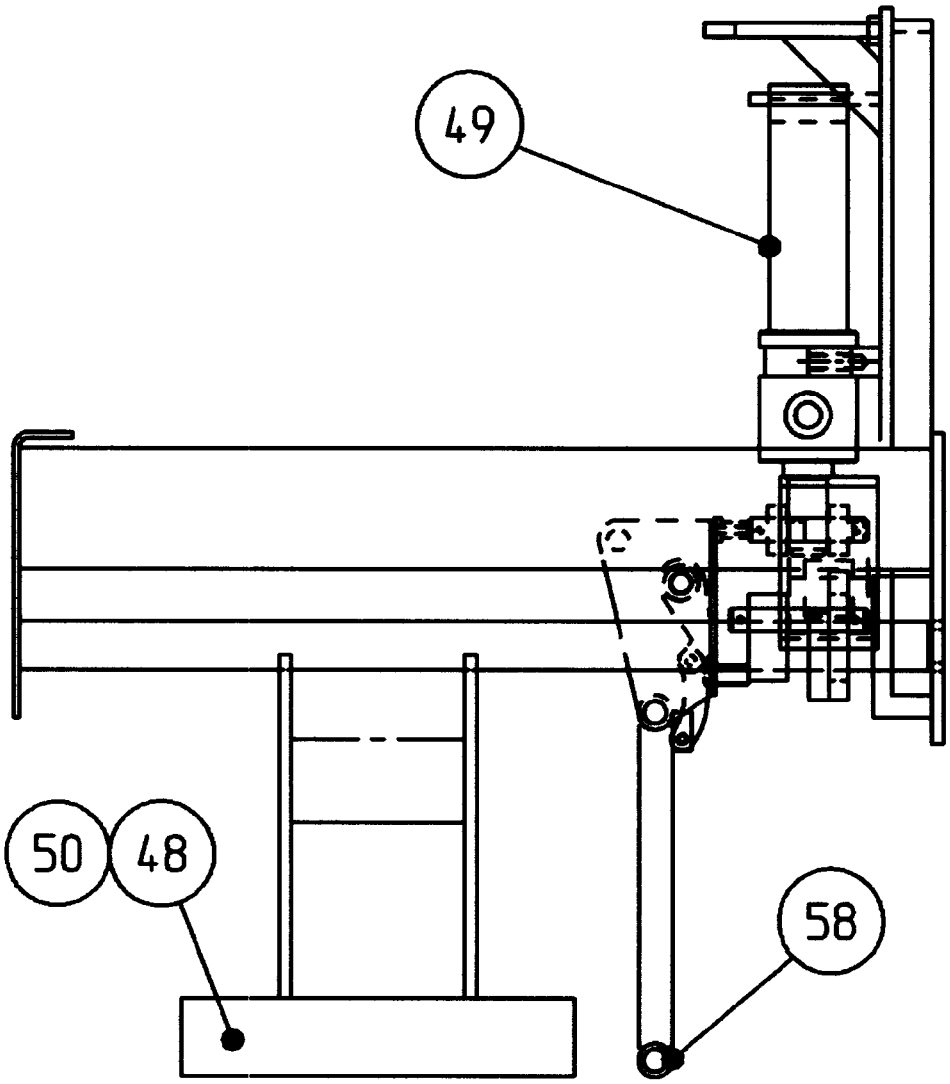
FIG. 2A is a side view from the opposite side in FIG. 1, of the basic elements of the propelling mechanism.

Referring to the drawings, and firstly to FIGS. 4 and 5 which show the playing field or area, this field 10 may for example be the turf surface of an existing stadium, and to play the game there is erected around the perimeter of the playing are 10 a perimeter fence 12 which as shown in FIG. 5 is provided on the inside with a fillet 14 which serves to return the ball off the inside of the fence to the flat playing surface 16. This fillet is desirable because otherwise the ball could become trapped in the corner of the fence and be prevented from being retrieved by the playing vehicles of the type shown herein. The fence may be made up of plastic sections clipped or otherwise secured together so that the fence can be erected easily and quickly on any suitable play area.

At opposite ends, the playing are 10 is provided with goals or goal areas 18 each of which is defended by a player sitting in a vehicle of the type shown in FIGS. 3, 4 and 5 whose function and operation will be explained hereinafter.

The function and operation of the game is that a number of playing vehicles of any of the types shown herein roam around the playing area collecting and propelling a ball (indicated in dotted lines) at 20 in FIG. 1 and loose in FIG. 2, the vehicles being arranged in teams, and the purpose being to score goals in the goal areas 18 of the opposing team, in much the same way as soccer. Because usually powered vehicles are involved, the rules stipulate that there should be no contact between the playing vehicles and optionally the fence 12, and to this end the play of the game preferably is stringently controlled both by a referee and/or by automatic means as will be explained hereinafter.

The respective vehicles which are used, each of which is unique in its own right, will now be described.

One form of playing vehicle is shown in FIGS. 1, 2 and 2A and comprises basically an open frame 22 which is supported through an appropriate chassis on three wheels 24, 26 and 28. The wheels 24 and 26 are towards the rear of the frame 12 and are on a common axis, whilst the front wheel 28 is to the front of the frame and is a caster wheel and can freely pivot about caster axis 30 which is vertical. The wheels 24 and 26 are respectively driven by means of hydraulic motors embodied therein or connected thereto, and they receive a hydraulic fluid from a pump 32 driven by a small internal combustion engine 34. Although not shown, the vehicle includes a sump or tank from which oil is drawn, and to which used oil is discharged. The tank is in fact illustrated in FIGS. 8 and 9 by the reference numeral 33.

It should be mentioned that the playing vehicle is illustrated only diagrammatically, and no attempt has been made to illustrate all of the components which are engineering components provided to give the vehicle the function as described herein.

The wheels 24, 26 and 28 support the frame 22 sufficiently clear above the playing surface 16 so that the ball 20 can pass under the front end of the frame 22, and can enter a funnelled section 35 defined by curved side plates 36 and 38, leading to a central lower guide channel 40 lying centrally of the machine and extending front to rear thereof. As the ball is captured in the funnel section 35 and as the vehicle moves forward, so the ball moves rearwards of the vehicle and is caught in a manipulating zone 42 by which the ball can be propelled sideways in either direction as indicated by arrows 44 and 46, or can be caused to be released rearwards as a result of being left behind when the vehicle continues its forward movement.

The propelling means for the ball (shown in slightly more detail and from the other side in FIG. 2A) from the location 42 comprises a pair of propelling arms or bars 48, 50 which can be manipulated by a ram 49 through a suitable linkage (not shown) in various ways. Firstly, the ram can hold the bars 48 and 50 so that the ball 20 when in location 42 remains laterally trapped, but subsequently by manipulation of control handles 52, 54 accessible to a player sitting in the vehicle seat 56, the bars 48 and 50 individually can be caused to be swung rapidly to impact against the ball and propel it as indicated by arrow 44 or 46, the other bar 48 or 50 at this time being raised clear of the ball. In order to release the ball rearwards, a holding bar 58 is simply raised rearwardly using a different mechanism from the ram if need be, as indicated by arrow 60 in FIG. 1 so that the ball 20 rolls rearwardly of the vehicle and clear of same as the vehicle moves forward. The propelling device is shown in FIG. 1 to the rear of the vehicle, but in other embodiments herein described, it is located between the front and rear wheels and preferably lies more or less centrally of the vehicle, so that ejection of the ball can be viewed by the player, for more accurate shooting and passing of the ball. In this arrangement, the propelling device may be under the player's seat, and the engine may be located behind the seat.

Additionally, the vehicle has foot plates 62 on which the player may rest his feet, and an overhead protective frame 64 carries an antenna 66 by which the vehicle may be controlled by the referee, and finally the vehicle has a pair of warning flashing lamps 68 (red) and 70 (green). The green lamp is operative when the ball 20 is held in the vehicle in the position shown in FIG. 1, by photoelectric sensing means, and when the vehicle is immobilised, the red light 68 is operative.

Figure 8:
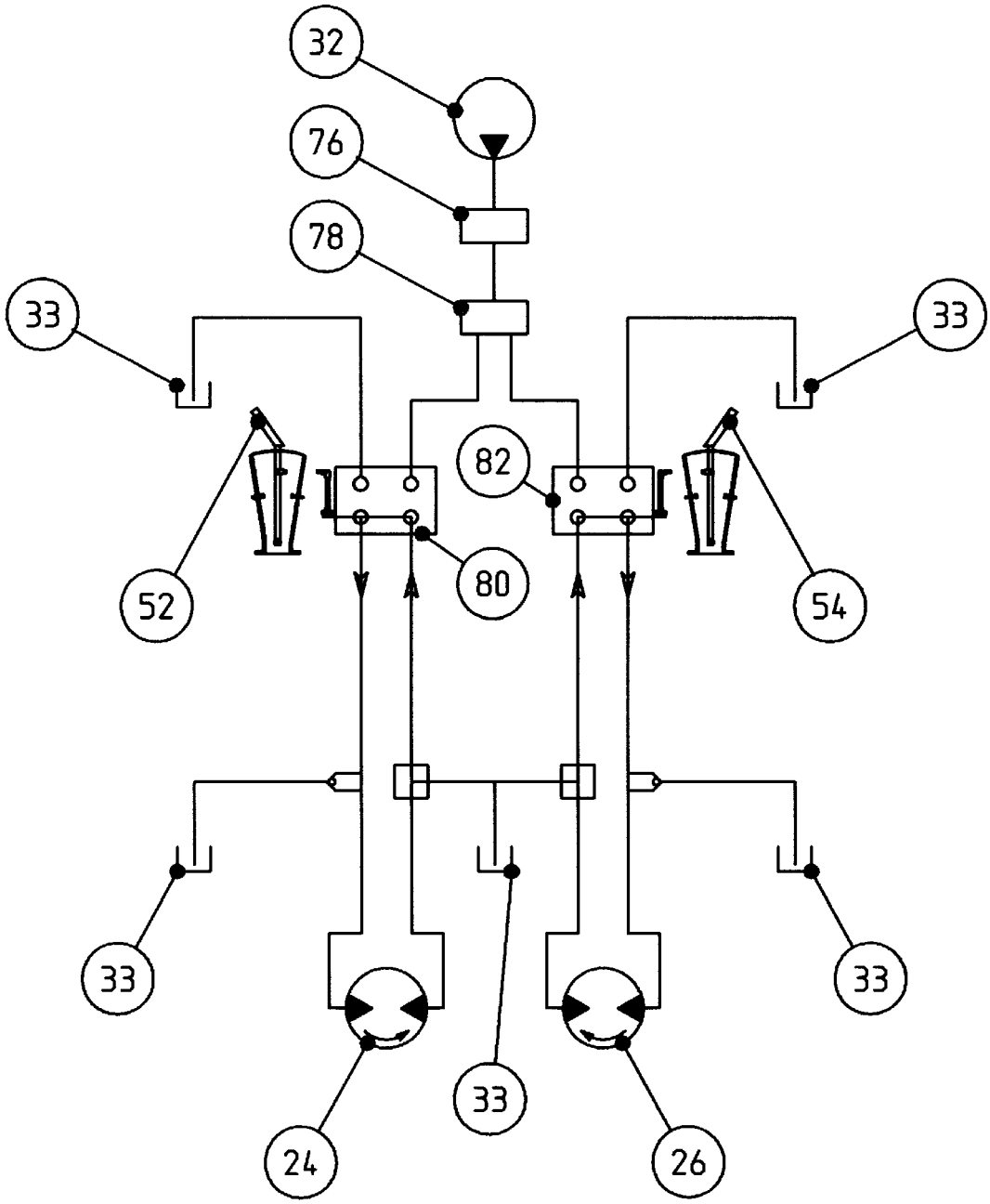
FIGS. 8 and 9 are circuit diagrams of the hydraulic circuits of the two motors respectively in different modes of operation.
Figure 9:
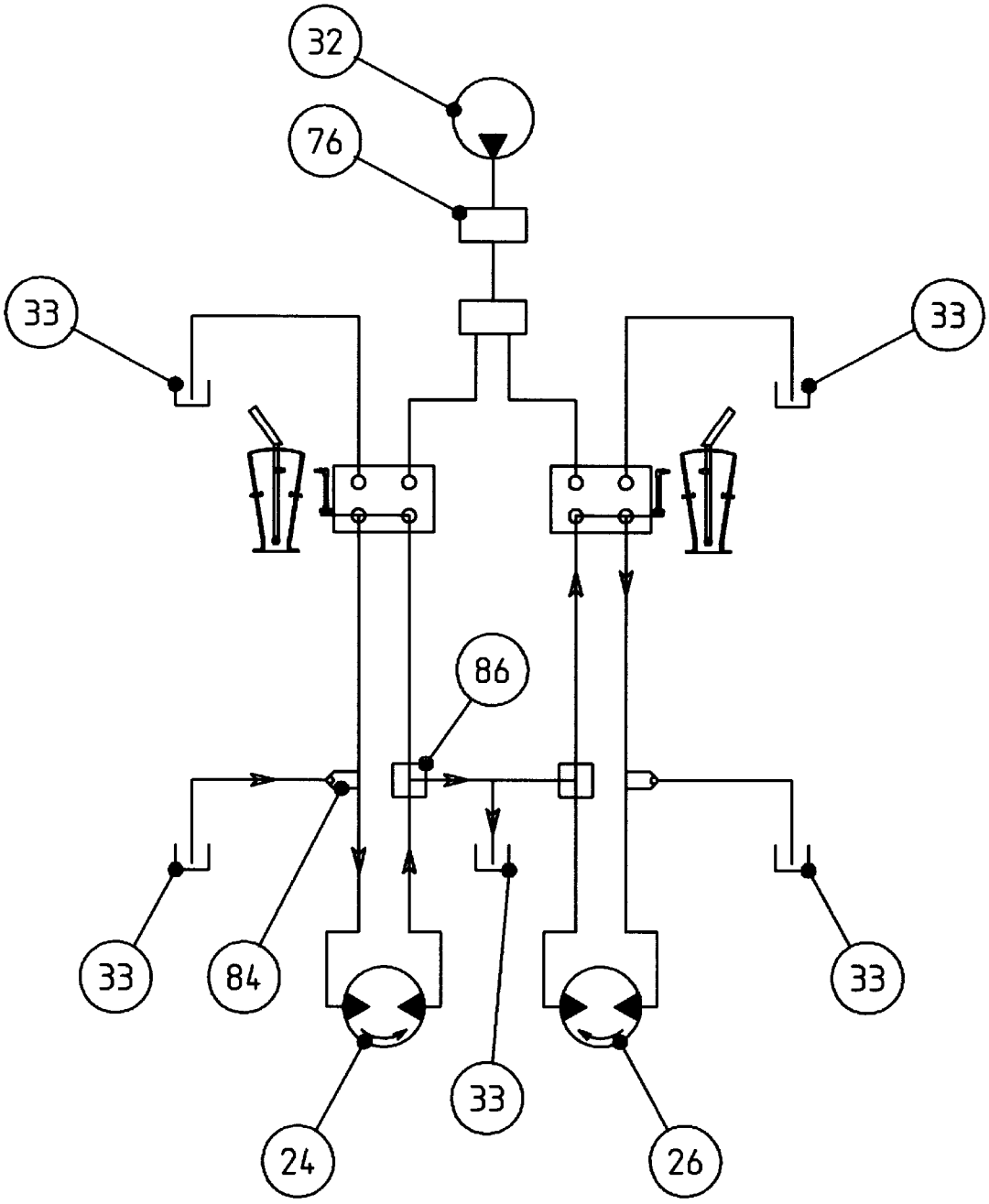

As indicated herein the drive for the wheels 24 and 26 is hydraulic in nature, and is so controlled in a unique fashion as described in relation to FIGS. 8 and 9, that the vehicle can be steered and manipulated over the playing area 10.

In order to explain the drive arrangement for the vehicle of FIGS. 1 and 2, reference is made to FIGS. 6 to 9.

Figure 6:
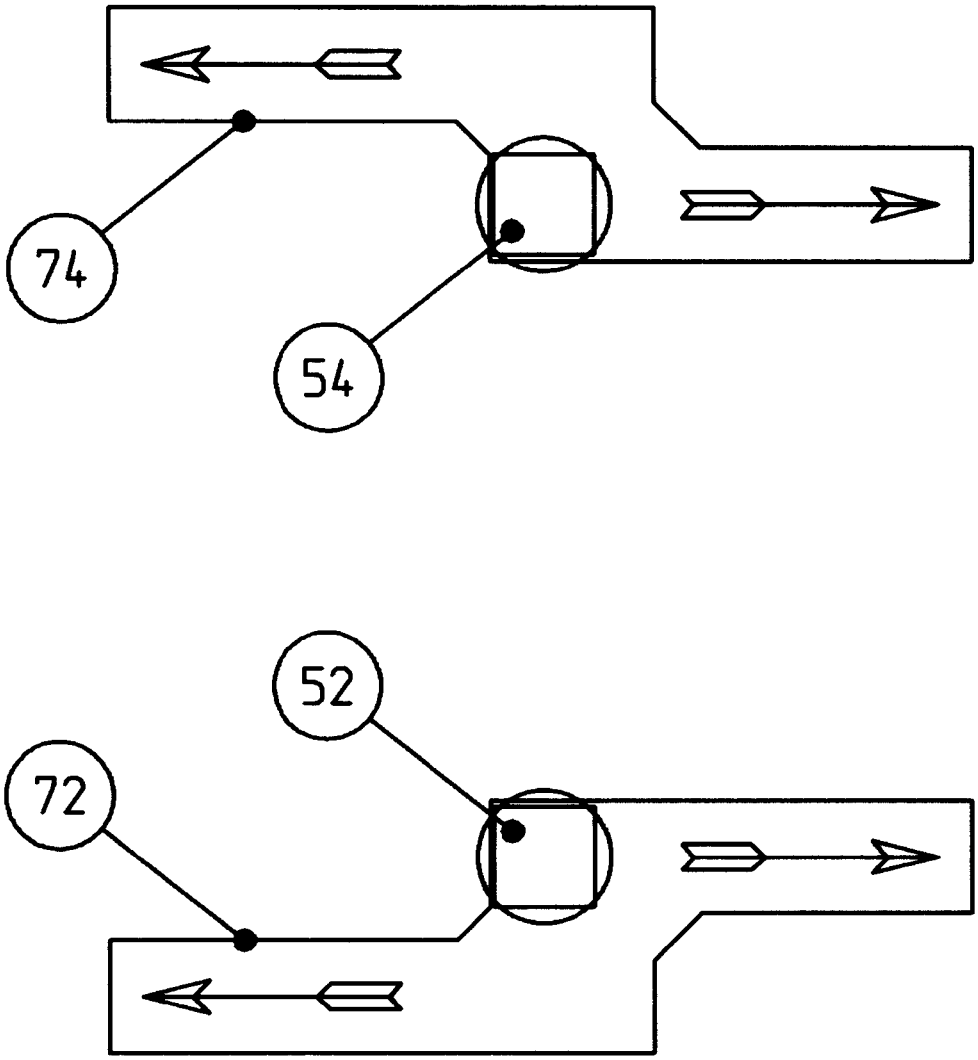
FIG. 6 is a plan view showing control handles which are provided in the player vehicle of FIGS. 1 and 2.

In FIG. 6, the two control handles 52 and 54 as shown operate in a pair of guide slots 72 and 74 of the form shown. The handles 52 and 54 are shown in the gate slot arrangements 72 and 74 in the stopped position i.e. each motor is stopped. The levers are spring loaded to return to this position if the operator simply releases the levers and therefore these levers operate on what is called the "dead man" principle. To drive the vehicle forward, the levers are moved together in the forwards direction as indicated along the gate slot, and to drive the vehicle in reverse, they are moved in the reverse direction.

Figure 7:
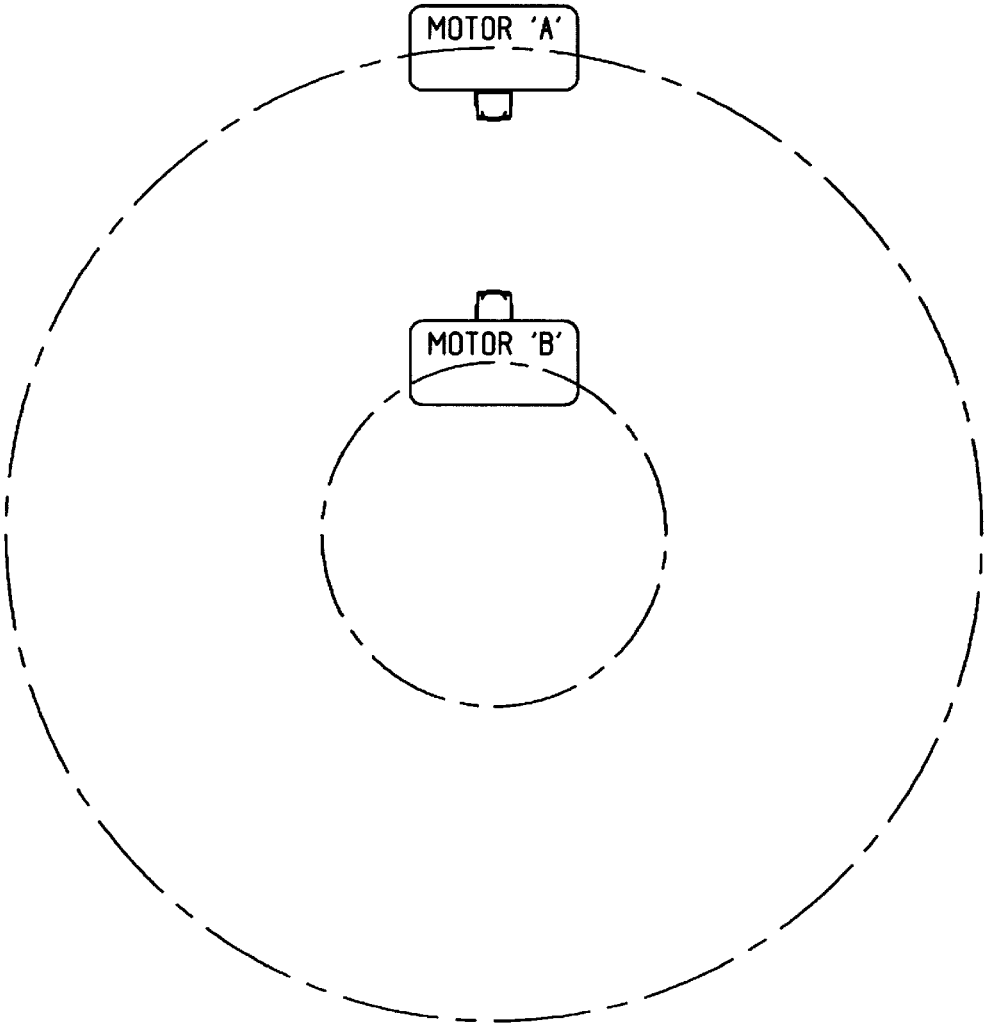
FIG. 7 is a view showing how the player vehicle can be driven around a circular path by virtue of the two drive wheels of the vehicle of FIGS. 1 and 2.

To steer the vehicle it is not a matter of pushing the levers forwards or rearwards differentially in order to have the wheels driving at different speeds, but that the steering movements to achieve a turning arrangement as indicated diagrammatically in FIG. 7 are achieved in a unique transmission arrangement which is another aspect of this invention, wherein the driving of one motor effects the forward propulsion, and tho ether motor is caused to operate temporarily as a pump to drive against back pressure. The circuit diagrams of FIGS. 8 and 9 show how in one embodiment this is achieved, and referring to these figures, the pump 32 is shown as delivering its output through a first relief valve 76 having a high relief pressure of say in the order of 2000 psi. From relief valve 76 output is delivered to a flow divider 78. The flow divider 78 equally splits the output between two control valves 80 and 82, which are controlled by the handles 52 and 54 to control the delivery of oil from the sump 33 to the motors 24 and 26. In the arrangement shown in FIG. 8, the motors 24 and 26 are being driven forwards under full pump output, and the flow of hydraulic oil is indicated by the arrows in FIG. 8.

When it is desired to steer the vehicle however, flow to one of the motors, say motor 24 from the pump 32 is blocked but full flow continues to the other motor 26. Motor 26 is therefore the propulsion motor and drives the vehicle forward. However, because it is unacceptable to have one of the motors locked and in skidding mode, which would cause damage to turf, according to this unique hydraulic arrangement, an extra pressure relief valve and check valve are provided in each of the lines to each of the motors 24 and 26. Thus, referring to FIG. 9, which shows a steering mode of operation, flow from the pump is blocked to motor 24, but motor 24 becomes in fact driven as a pump, and draws oil through the additional check valve 84 and motor 24 acts as a pump delivering its output to pressure relief valve 86 which is set at a lower relief pressure than valve 76, say in the order of 1500 psi, and the output is discharged back to the sump 33. The motor therefore continues to turn but acting as a pump during steering operations, and this is effective in steering the vehicle and in preventing damage to the grass or playing surface as a result of wheel skid.

This particular transmission arrangement could be adopted in any vehicle for any purpose where effective steering for the avoidance of skid is required and the aspect is not limited to the overall concept of this game. Other hydraulic arrangements may be adopted for achieving this motor overrun pumping mode arrangement when a vehicle is required to be steered. The pumps and motors used in this connection may be hydraulic hydrostatic transmission arrangements.

The hydraulic circuit described can make use of standard hydraulic components.

The motors which are used in the playing vehicle are relatively powerful and have a high torque output because the vehicles need rapid acceleration up to the maximum playing speed (which may be in the region of 12 km/h) and the provision of the steering system for these vehicles represents a considerable advantage.

With the steering arrangement provided, it has been possible to achieve a turning speed of 140 revs per minute on the outer driving vehicle, and a speed of 40 revs per minute on the inner driven wheel.

It will be appreciated that of course the caster wheel 28 takes up the appropriate position when the vehicle is executing turning movements.

It is envisaged that a special goal keeping vehicle can be provided if desired.

Referring to FIG. 3, the control box which can be used by a referee to control the vehicles is indicated by reference 130, and has a number of buttons as well as a transmitting antenna 132. The transmitting antenna can transmit to all of the vehicles playing the game, and the controller illustrated is for use with a game wherein there are five outfield players 1, 2, 3, 4 and 5, of each team. The controller can control all of the vehicles either one by one or simultaneously, by operation of five individual buttons or a single button 134, and additionally the device 130 has a battery indicator 136 to indicate the conditions of the battery, and an on/off switch 138 to save the battery power.

To use the controller 130 the referee observes the game, and presses the individual buttons as appropriate whereupon signals are delivered from the antenna 132 to the respective vehicles or all of the vehicles in order to immobilise say a vehicle containing a player who is committing a breach of the rules, or to immobilise all of the vehicles at the end of play or a section of play.

Additionally, the player vehicles indicated in FIGS. 1 and 2 comprise a sensitive front pad 112 and each of these vehicles can be self-immobilised if the pad 112 contacts another vehicle. It is again mentioned that the game is intended to be a non-contact sport, having regard to the fact that collisions between powered vehicles could be dangerous.

The signals from the controller 130 may be by any suitable through air transmission means such as radio waves, ultrasonics, infrared and the like. It will also be appreciated that each unique button for each team can immobilise the appropriate vehicle each time there is a breach. Immobilisation may be for a pre-set period of time say 1 minute or 2 minutes so that any player committing a breach can be put out of the game by way of penalty. The player can also put himself out of the game by bumping into another vehicle with his front end.

The described game concept provides an exciting and extremely novel form of entertainment, but it can also be used for competition and for skills learning i.e. corporate interfunctioning and the like.

The other figures show various modifications and adaptations, and it is to be mentioned, before describing the other figures, that any feature of the vehicles already described can, where appropriate, be included in any of the modifications to be described and vice versa, and indeed any feature of the modified vehicles can be used with any of the other modified vehicles described.

As will be understood, the players will require the skills of conventional ball players combined with the skills of handling vehicles usually self propelled but including pedal cycles, motor cycles, tricycles or four wheeled vehicles of any type, and the steering and rive wheels and the position of the engine and transmission systems and the driver are so positioned to assist in ball handling.

The vehicles are equipped to effect three key elements of normal ball games including catch, hold and pass.

The ball may be of any conventional size and type but generally similar to a basketball or football but being of a lower pressure type so as to restrict the amount of ball bounce as generally speaking the ball will always remain in contact with the ground surface, although in certain applications, the holding section of the device may incorporate carrying features so that the ball is not always in contact with the surface when held within the machine or attachment.

The three main ball handling areas on the player machine are characterised as the funnel (catching) the ball duct (holding) and the ball ejection mechanism (for passing). They are part of the complete machine and another version of the ejection or passing mechanism is described with reference to FIGS. 17, 18 and 19 which will allow for ejection to either side, i.e. passing to the right or the left or alternatively releasing the ball (as in football with a back pass).

As described, the controls of the ejection mechanism will be timed relative to the travel distance of the whole machine as the game will be played according to defined rules and therefore the ball must pass from one machine (player) to the next to achieve fast and regular ball movements, i.e. passing, to make the game challenging and enjoyable.

The game will require minimum physical effort if played with a self propelled machine, which means that drivers of all ages and/or sex are able to play the game on equal terms according to their skills and not physical condition.

Any combination of the three main functions, i.e. the funnel area, the ball duct area and the ejection area could be arranged in any combination.

Figure 11:
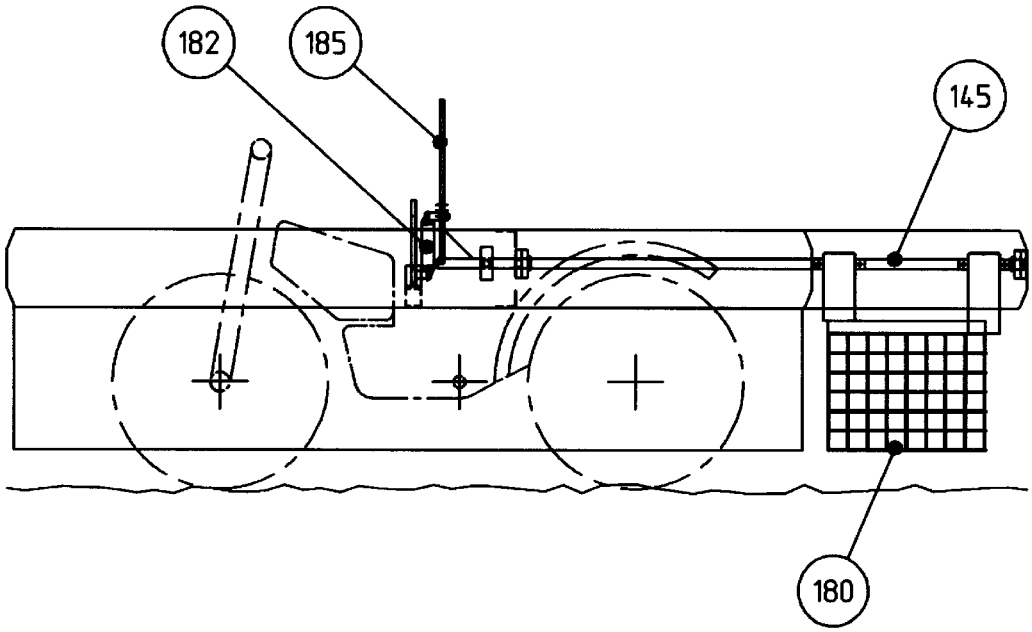
FIGS. 11 and 12 show in side and end elevation the holding and propelling means of the attachment of FIG. 10.
Figure 12:
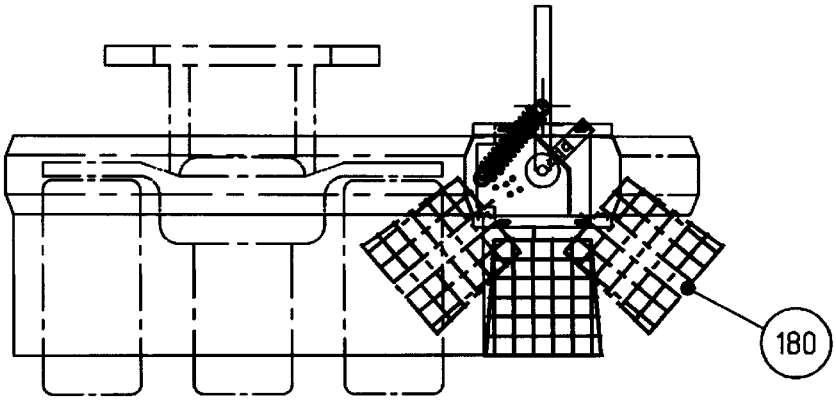

Various means of ball ejection could be used being either electrical/electro-magnetic, hydraulic or pneumatic and it may comprise a simple inverted basket 180 arrangement as shown in FIGS. 11 and 12 which passes or ejects the ball to the right or left, and can be used for releasing the ball directly behind the machine (as a back pass), by on the one hand operating the ejection mechanism to one side or the other when the ball is in the ball duct, or in the other hand by accelerating the machine forward so that the ball would be left behind by the machine, therefore releasing the ball to be caught by other players/machines.

Figure 10:
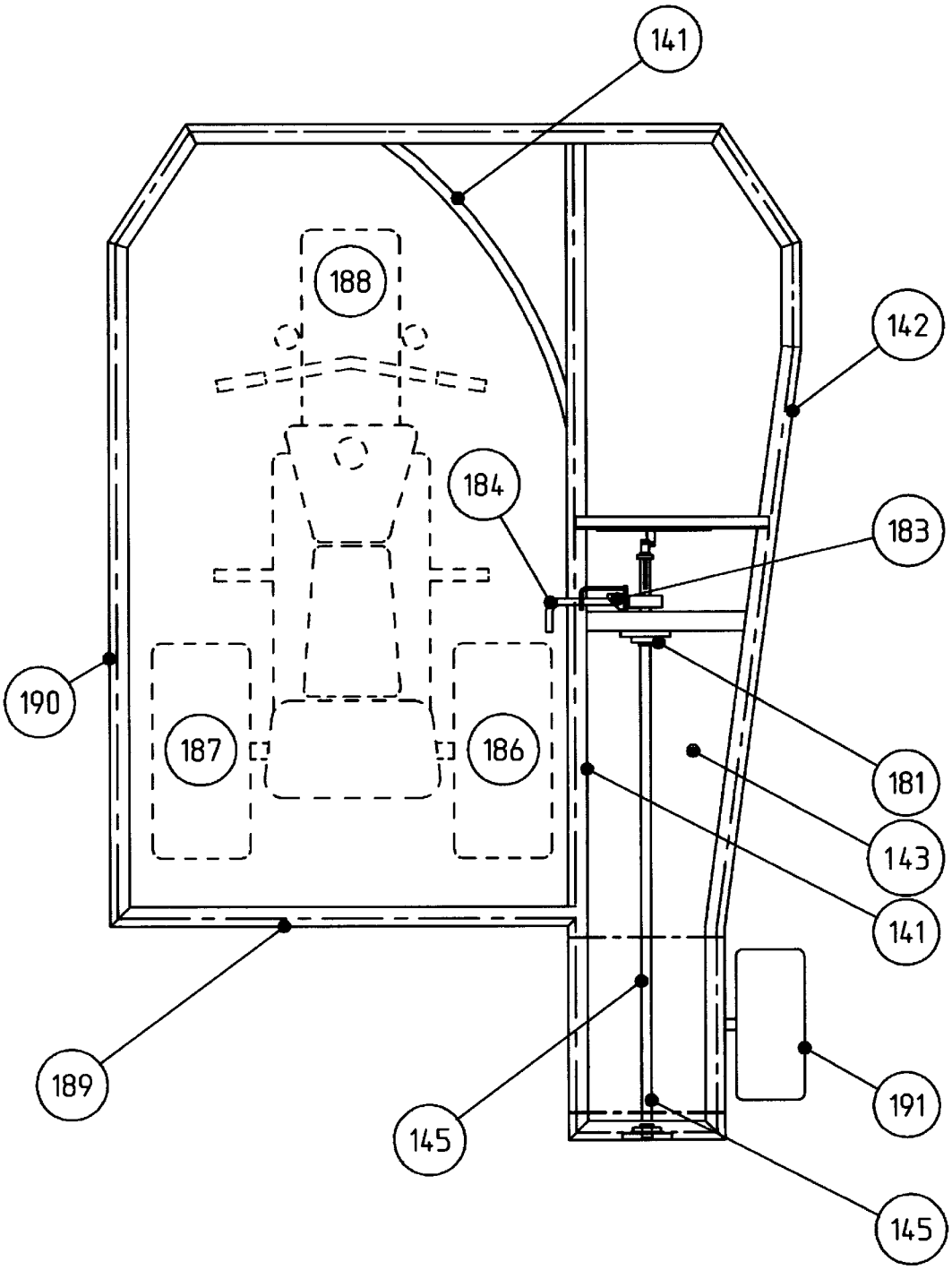
FIG. 10 shows an embodiment of the invention, when in the form of an attachment for an existing vehicle.

Referring now to FIGS. 10, 11 and 12, an attachment machine is shown and it is provided with the main features as aforementioned.

Again, the main elements of the frame defining the funnel or catching area are referred to by 141, 142, the ball duct by 143, and the ejector mechanism by item 145.

In this attachment, a basket device 180 is used, in conjunction with a mechanical linkage item 181, a spring 182 which engages a cam arrangement 183, and a manual release lever 184 to operate the spring 182 so that the player can select the release time in a manual way with no electronic timing devices and the ejection basket 180 is reset manually by the player (driver) by operating the lever 184.

FIG. 10 illustrates a tricycle machine with wheels 186, 187 and 188 but any conventional or mechanical or manually propelled vehicle could be used to propel the attachment which would be surrounded by skirts 189, 190.

In FIG. 10 the attachment is mounted on the right hand side of the machine when viewed from the driving position but could equal be on the left side or a pair of attachments could be fitted, one to each side. In this arrangement, the player steers with his feet and ejects the ball by hand operation.

In addition, the attachment could be fitted with an additional wheel 191 to support the attachment and to enable the machine to lean in either direction when turning corners as with conventional motor cycles and sidecars.

Figure 13:
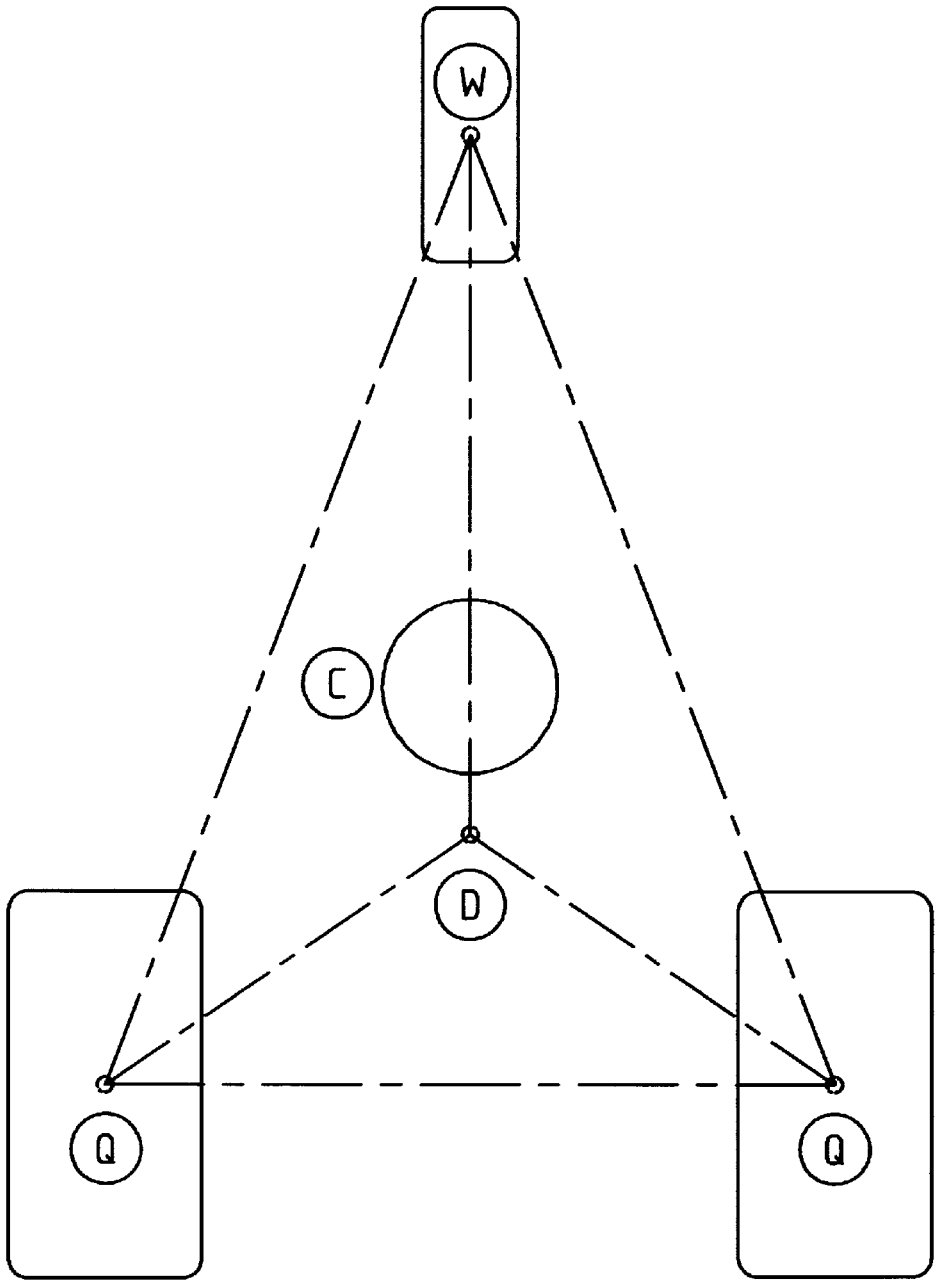
FIG. 13 is a diagram to show the preferred layout of the player vehicle wheels and holding and propelling means.

FIGS. 13 to 16 are included to show one possible design arrangement for the player vehicle. The vehicle shown in FIG. 13 is a tricycle having wheels W (front) and Q, Q (rear). The centre of gravity of the vehicle is shown at D, and region C indicates the position of the hold and propelling mechanism.

Figure 14:
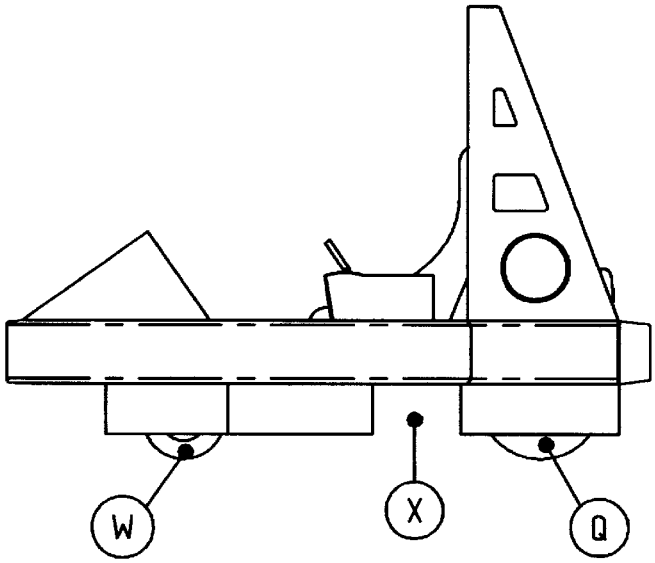
FIG. 14, 15 and 16 show in left side, end and right side elevation, a design configuration of the player vehicle.
Figure 15:
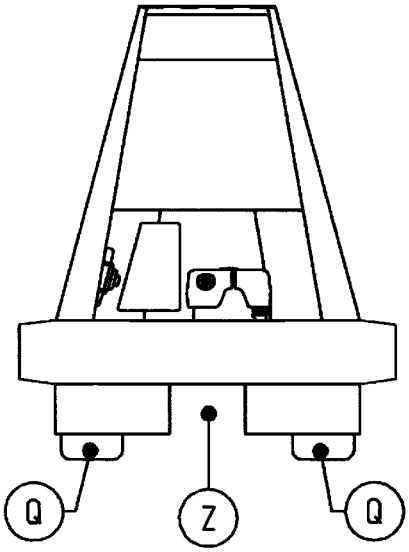
Figure 16:
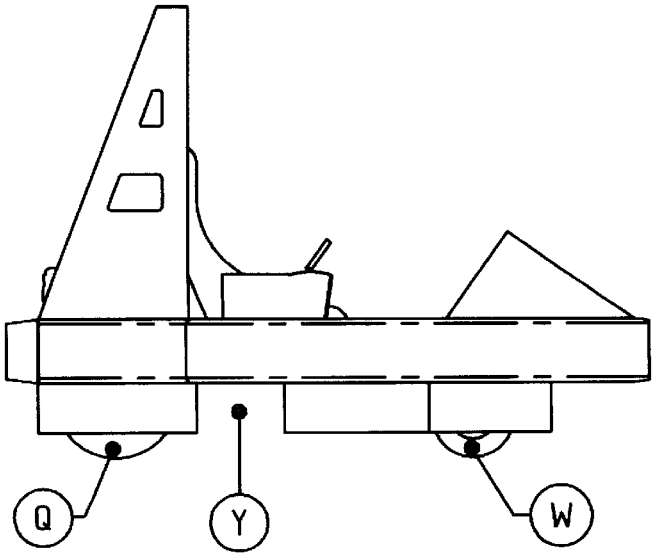

FIGS. 14 to 16 show the same vehicle as FIG. 13 and it will be seen that there are side channels X and Y through which the ball may be propelled from the sides of the vehicle and the centre duct is indicated by Z. The vehicle otherwise functions as described hereinbefore.

Figure 17:
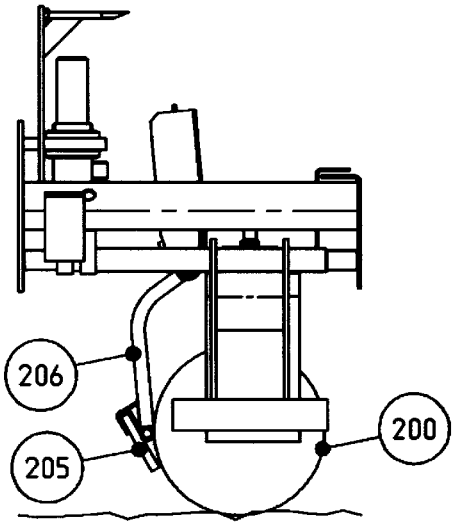
FIGS. 17, 18 and 19 show a side view, an end view in a first position, and an end view in a second position, of another holding and propelling means, usable with any of the player vehicles.
Figure 18:
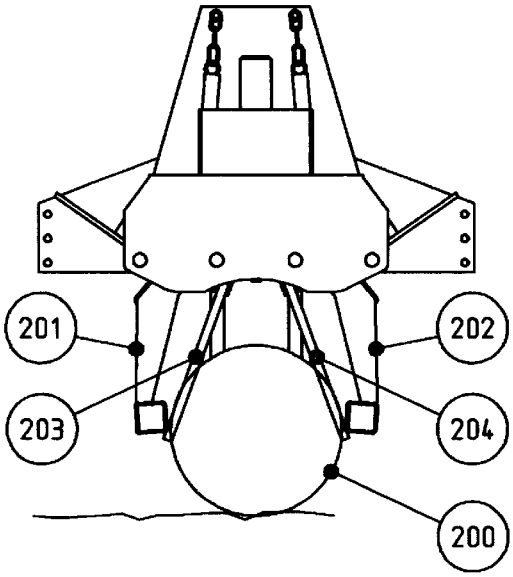
Figure 19:
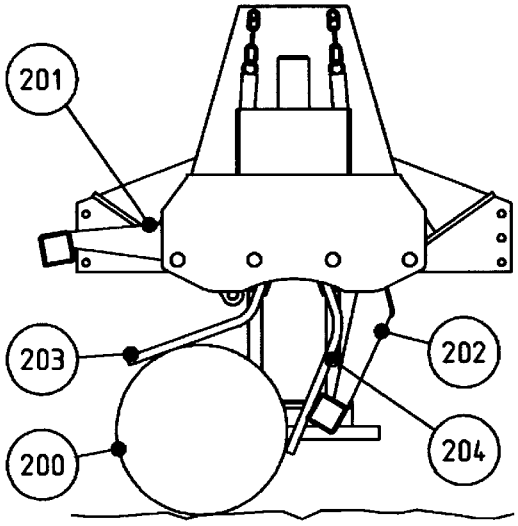

FIGS. 17, 18 and 19 show a preferred form of the holding and propelling mechanism which incorporates a feature to prevent the ball 200 from rolling out of position relative to the striker bars 201, 202, as the vehicle is driven round a curved path. This modification comprises the addition of resilient members in the form of flexible brush bristles 203, 204 and 205, preferably of polypropylene.

Bristles 203, 204 are located at the sides of the holding zone and serve to hold the ball 200 when one striker bar 201 or 202 is raised, and when the other bar 201, 202 is moved to strike the ball (as shown in FIG. 19), the bristles 203 or 204 flex giving good ejection of the ball in every occasion.

The bristles 205 are mounted to the rear of the holding and ejecting device or the tail gate 206. The bristles 205 are close to the ground and slightly lift the ball 200 as the vehicle travels forward, but should the ground be uneven, then the bristles 205 can flex without damage.

Figure 20:
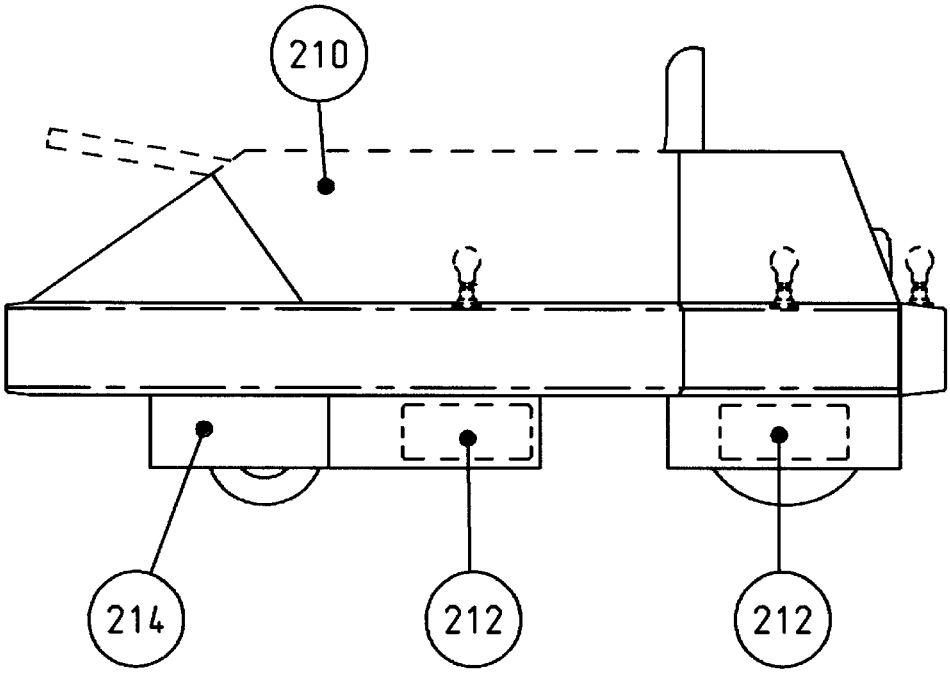
FIGS. 20 and 21 are a side view and an end view of a modified form of player vehicle.
Figure 21:
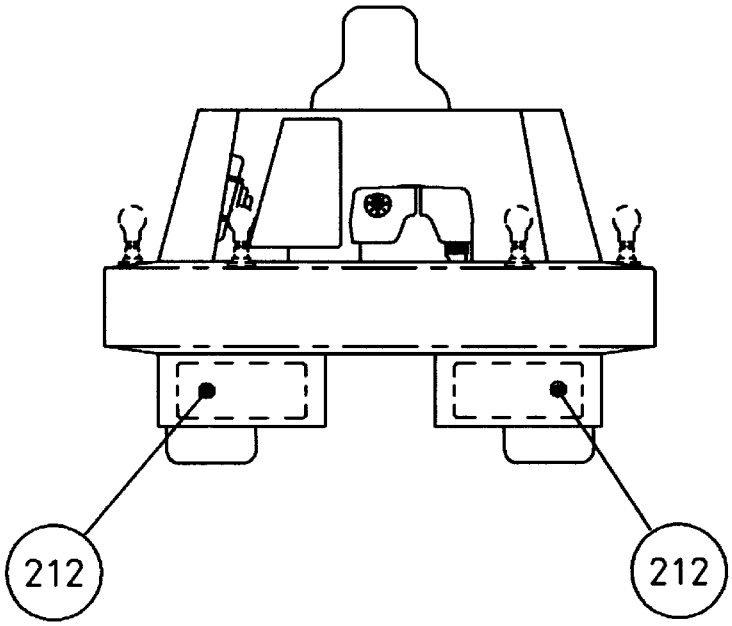

FIGS. 20 and 21 show another modification which is that the vehicle is designed as a battle tank and can be used in a "war" type game. The vehicle 210 is designed to hold and propel a ball as described, but the vehicles also has pressure pads 212 around a skirt 214. The pads 212 are sensitive devices connected by a micro-processor to the vehicle's drive system in a similar manner to the touch pad described herein. Above each pressure pad 212 is a light which flashes as long as the pad has not been struck by the ball. As each pad is truck, the light goes out and when all pads 212 have been hit the vehicle is immobilised and is out of the game. When all vehicles of one side have been immobilised, the game is over, and the other side has won.

We claim:

1. A vehicle for playing a game on a surface (16) over which the vehicle moves, comprising a front, sides and a rear, an inlet (35) at the front for collecting a ball (20) as the ball rolls on the surface (16), a holding zone (42) for holding the ball (20), and a propulsion means for propelling the ball (20) from the vehicle, characterized in that at least one of the sides has an outlet and in that the propulsion means (50,48) is operable to propel the ball (20) through said outlet across the surface (16) in the direction transverse to the front to rear direction of the vehicle.

2. The vehicle according to claim 1, wherein vehicle is motorised.

3. The vehicle according to claim 2, wherein the vehicle has a center and the holding zone (42) is at the center or rear of the vehicle.

4. The vehicle according to claim 3, wherein the propulsion means comprises striking arm means (50,48) whereby the ball can be propelled sideways from either side of the vehicle.

5. The vehicle according to claim 4, wherein the striking arm means (50,48) comprises right and left arms, arranged so that when one arm strikes the ball (20) the other is raised clear of the holding zone (42).

6. The vehicle according to claim 4, including resilient holding means (203,204) for resiliently holding the ball in the holding zone (42), which resilient holding is overcome when the ball (20) is propelled by the arms (201,202) from the holding zone.

7. The vehicle according to claim 6, wherein the resilient holding means comprises flexible polypropylene bristles (203,204).

8. The vehicle according to claim 1, wherein the ball (20) can be released from the holding zone (42), in addition to being propelled therefrom by forward propulsion of the vehicle.

9. The vehicle according to claim 8, wherein there is a closure member (58) defining the rear of the holding zone (42) and means (49) for raising the closure member to release the ball (20) when the vehicle moves forward.

10. The vehicle according to claim 2, wherein the vehicle is a three wheeled vehicle with a single front wheel (28) and two rear wheels (24,26) and the inlet (35) extends from each side of the front to the holding zone (42).

11. The vehicle according to claim 10, wherein the vehicle is driven by a prime mover drivingly connected to the respective rear wheels (24,26) enabling them to be driven differentially.

12. The vehicle according to claim 10, wherein the front wheel (28) is a caster wheel.

13. The vehicle according to claim 1, wherein the vehicle has a sensor means which if impacted by the ball (20) during play, senses this.

14. The vehicle according to claim 13, wherein there are four sensor means at four corner locations of the vehicle.

15. The vehicle according to claim 1, wherein the vehicle has receiver means (66) whereby it can be controlled by a transmitter (132).

16. The vehicle according to claim 15, wherein the vehicle has an indicator (68) to indicate when it has been controlled by said transmitter.

17. The vehicle according to claim 16, wherein said indicator comprises a lamp (68).

18. The vehicle according to claim 1, wherein the vehicle is equipped with an impact controller whereby the vehicle is stopped upon impact with another similar vehicle or the boundary of a play area.

19. A vehicle with an attachment for playing a game on a surface (16) over which the vehicle and attachment move, the attachment comprising a front, sides and a rear, an inlet (35) at the front for collecting a ball (20) as the ball rolls on the surface (216), a holding zone (42) for holding the ball (20), and a propulsion means for propelling the ball (20) from the attachment, characterised in that at least one of the sides has an outlet and in that the propulsion means (50,48) is operable to propel the ball (20) through the outlet across the surface (16) in a direction transverse to the front to rear direction of the attachment.

20. An attachment for a vehicle, to enable the vehicle with the attachment to play a game on a surface (16) over which the vehicle and attachment move, comprising a front, sides and a rear, an inlet (35) at the front for collecting a ball (20) as the ball rolls on the surface (16), a holding zone (42) for holding the ball (20), and a propulsion means for propelling the ball (20) from the attachment, characterised in that at least one of the sides has an outlet and in that the propulsion means (50,48) is operable when the attachment is attached to the vehicle, to propel the ball (20) through the outlet across the surface (16) in a direction transverse to the front to rear direction of the attachment.

* * * * *